United States Patent [19]

Kasai

[11] Patent Number: 4,539,735

[45] Date of Patent: Sep. 10, 1985

[54] SNAP-FIT BUTTON ASSEMBLY

[75] Inventor: Kazumi Kasai, Namerikawa, Japan

[73] Assignee: Nippon Notion Kogyo Co., Ltd., Tokyo, Japan

[21] Appl. No.: 556,897

[22] Filed: Dec. 1, 1983

[30] Foreign Application Priority Data

Dec. 1, 1982 [JP] Japan ..... 57-182340[U]

[51] Int. Cl.[3] ..... A44B 17/00

[52] U.S. Cl. ..... 24/621; 24/622; 24/681; 24/691

[58] Field of Search ..... 24/621, 622, 623, 624, 24/662, 681, 689, 690, 691, 692, 693

[56] References Cited

U.S. PATENT DOCUMENTS

| | | | |
|---|---|---|---|
| 1,782,165 | 11/1930 | Ford | 24/691 |
| 2,368,100 | 1/1945 | Boenecke | 24/681 |
| 3,107,408 | 10/1963 | Huelster et al. | 24/621 |
| 3,195,201 | 7/1965 | Ash | 24/689 |
| 3,349,451 | 10/1967 | Maeno | 24/621 |
| 3,613,181 | 10/1971 | Taylor | 24/662 |
| 4,253,226 | 3/1981 | Takeda | 24/691 |

FOREIGN PATENT DOCUMENTS

| | | | |
|---|---|---|---|
| 541524 | 12/1941 | United Kingdom | 24/623 |
| 936095 | 9/1963 | United Kingdom | 24/691 |

*Primary Examiner*—Victor N. Sakran

*Attorney, Agent, or Firm*—Hill, Van Santen, Steadman & Simpson

[57] ABSTRACT

A snap-fit buttom assembly comprises a female and a male member both molded and adapted to be coupled together with a snap-fit and a pair of tack members adapted to be joined with the female and male members for attachment thereof to a pair of fabric pieces separately. The female member, which is composed of a circular plate-like base and a cylindrical socket integral therewith, has along its periphery a plurality of openings each extending through the base and merging with the socket's bore receptive of a plug of the male member. The openings are angularly aligned, about the axis of the female member, with a plurality of inwardly directed locking projections of the socket. In production, the female member can be molded on a pair of mold halves; one mold half for shaping the base has a plurality of projections each having a contour corresponding to the shape of the individual opening.

5 Claims, 15 Drawing Figures

SNAP-FIT BUTTON ASSEMBLY

BACKGROUND OF THE INVENTION

1. Field of the Invention

The present invention relates to a button assembly including a male and a female member adapted to be coupled together with a snap fit and a pair of tack members adapted to be joined with the male and female members for attachment thereof to a pair of fabric articles separately.

2. Prior Art

A known button assembly comprises a female member having a base and a socket integral therewith and provided with an inwardly directed locking projection extending along its tip end, a male member having a base and a plug integral therewith and provided with an outwardly directed locking projection extending along its tip end; the male member's locking projection is engageable with the female member's locking projection for coupling the male and female members together. The prior button assembly also includes a pair of tack members adapted to be joined with the female and male members for attachment thereof to a pair of fabric pieces separately. Each of the male and female members is produced from synthetic resin on mold halves; in the production of the female member, however, because of the inwardly directed projection disposed on the socket, it is difficult to eject or remove the female member from one mold half (which has a hollow shaped complementary to the contour of the socket) without deformation or other damage of the socket. In order to facilitate removing of the female member from the mold, it has been the practice to reduce the height of the locking projection or the thickness of the socket wall to a minimum. This reduction of the projection's height causes inadequate coupling of the male and female members, while the reduction of the socket wall's thickness makes the female member mechanically weak. Consequently, it has been difficult to make large button assemblies of this type that require a considerable degree of coupling strength of male and female members.

SUMMARY OF THE INVENTION

According to the present invention, a snap-fit button assembly comprises a female and a male member adapted to be coupled together with a snap fit and a pair of tack members adapted to be joined with the female and male members for attachment thereof to a pair of fabric pieces separately. The female member, which is composed of a circular plate-like base and a cylindrical socket integral therewith, has along its periphery a plurality of openings each extending through the base and merging with the socket's bore receptive of a plug of the male member. The openings are angularly aligned, about the axis of the female member, with a plurality of inwardly directed locking projections of the socket. In production, the female member is molded on a pair of mold halves; one mold half for shaping the base has a plurality of projections for forming the respective openings in the base.

It is therefore an object of the invention to provide a snap-fit button assembly having a mechanically strong female member which not only can be coupled with a male member with adequate firmness, but also can be produced on a pair of mold halves easily without deforming or otherwise damaging any part of the female member when the latter is removed from the mold halves.

Another object of the invention is to provide a snap-fit button assembly having a female member which, when attached to a fabric piece, is free from being angularly displaced relative to the fabric piece.

Many other advantages, features and additional objects of the invention will become manifest to those versed in the art upon making reference to the detailed description and the accompanying drawings in which a preferred embodiment incorporating the principles of the present invention is shown by away of illustrative example.

DETAILED DESCRIPTION

Figure 1:
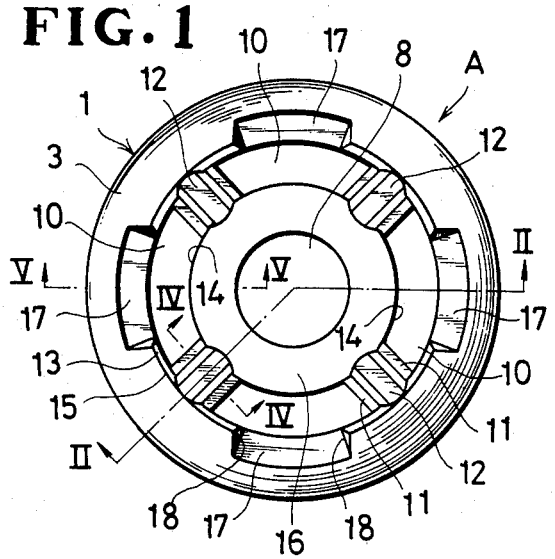
FIG. 1 is a plan view of a female member of a snap-fit button assembly according to the present invention.
Figure 2:
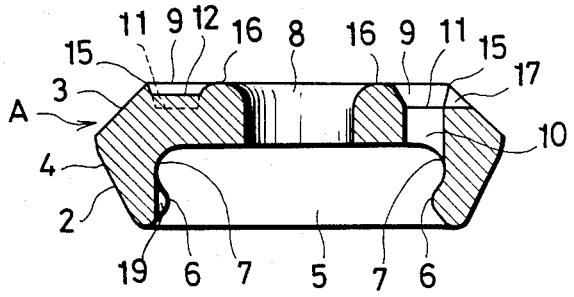
FIG. 2 is a cross-sectional view taken along line II—II of FIG. 1.
Figure 3:
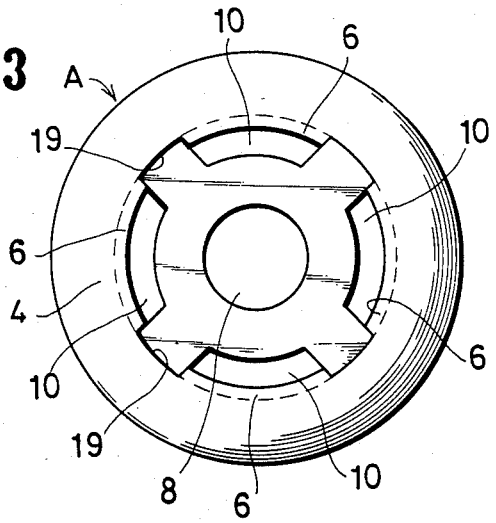
FIG. 3 is a bottom view of the female member of FIG. 1.

As shown in FIGS. 1–3, a female member, generally indicated by the reference character A, has a circular plate-like base 1 and a cylindrical socket 2 disposed on the underside of and integral with the base 1. The base 1 has a peripheral surface 3 inclined inwardly upwardly. The socket 2 has a peripheral surface 4 inclined inwardly downwardly and substantially parallel to the underside surface of the base 1.

The socket 2 has a central bore 5 for receiving therein a male member D (described below). The socket 2 also has along its tip end four inwardly directed locking projections 6 which partly define with the under surface of the base 1 a cave or cavity 7 for a purpose described below.

Figure 5:
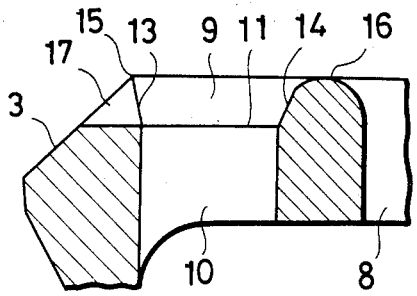
FIG. 5 is an enlarged fragmentary cross-sectional view taken along line V—V of FIG. 1.

The base 1 has at its center an aperture 8 for receiving a shank 21 of a tack member B (described below in connection with FIG. 6), the aperture 8 opening into the bore 5 of the socket 2 and being defined by an annular roundfaced portion 16 (FIGS. 1, 2 and 5). The base 1 also has an annular intermediate portion disposed between the annular round-faced portion 16 and the socket 2, the annular intermediate portion having four arcuate openings 10 and four radial grooves 9 disposed one between each adjacent pair of the openings 10. Each opening 10 communicates with the cavity 7 and is aligned therewith in a direction parallel to the axis of the socket 2. The grooves 9 are disposed on the upper surface of the base 1 which surface is engageable with a fabric piece C when the female member A is attached thereto as described below in connection with FIG. 8.

Figure 4:
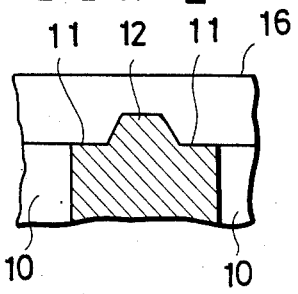
FIG. 4 is an enlarged fragmentary cross-sectional view taken along line IV—IV of FIG. 1.

As shown in FIG. 4, each radial groove 9 has at its bottom 11 a radially extending ridge 12 of trapezoidal cross-section having a height smaller than that of the annular round-faced portion 16

A pair of opposed concentric inner and outer annular surfaces 14, 13 of the base 1 extends along the intermediate portion (i.e. the openings 10 and the grooves 9) at opposite sides thereof. The inner and outer annular surfaces 14, 13 are so inclined that the width of the annular intermediate portion (unnumbered) becomes gradually smaller downwardly toward the bottom of the base 1. The inclined outer annular surface 13 thus defines with the inclined peripheral surface 3 four arcuate tapering edges 15 each disposed adjacent to a resepctive one of the four radial grooves 9. An adajcent pair of the arcuate edges 15 is spaced apart from one another by an arcuate recess 17 merging with a respective one of the arcuate openings 10. Each recess 17 has a depth equal to the maximum depth of the individual radial groove 9 and is defined at opposite ends by a pair of outwardly inclined end surfaces 18, 18 (FIG. 1). Each adjacent pair of the locking projections 6 is spaced apart from one another by a recess 19 which is angularly aligned with and disposed below a respective one of the radial grooves 9 and is thus in vertical alignment or registration therewith.

In production, the female member A is molded on a pair of mold halves (not shown); one mold half for shaping the base 1 has four projections for forming both the respective openings 10 in the base 1 and part of the socket bore 5 (i.e. the cavity 7) which part is vertically aligned with the openings 10. Since the four openings 10 of the base 1 and thus the four projections of the base shaping mold half are vertically aligned with the respective locking projections 6 of the socket 2, it is possible to remove either the base-shaping mold half or the socket-shaping mold half from the fresh molded female member A easily without deforming or otherwise damaging any part, particularly the inwardly directed locking projections 6, of the socket 2, thus improving the rate of production. Further, with such base-shaping mold half, it is unnecessary to reduce the height of the locking projections 6 or the thickness of the socket wall; that is, it is possible to obtain a mechanically strong female member which can be coupled with a male member with adequate firmness.

Figure 6:
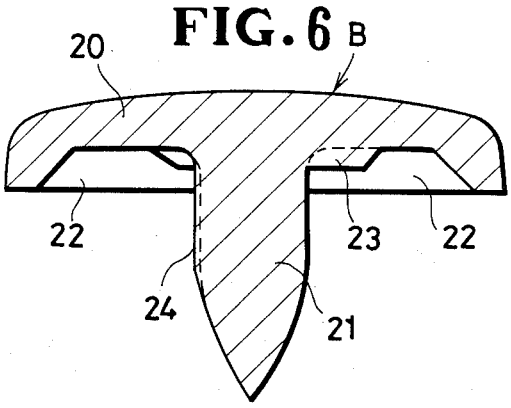
FIG. 6 is a vertical cross-sectional view of a tack member.
Figure 7:
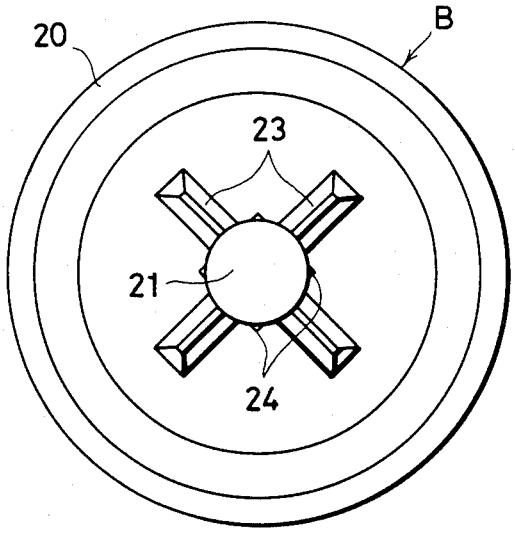
FIG. 7 is a bottom view of the tack member of FIG. 6.
Figure 8:
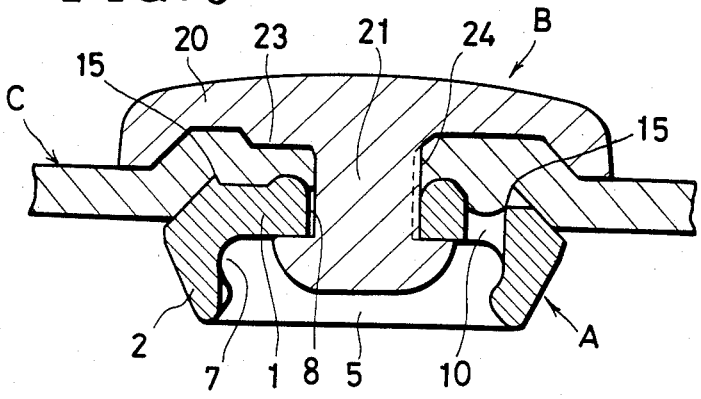
FIG. 8 is a cross-sectional view of the female member, showing the same having been attached to the fabric piece by the tack member.
Figure 15:
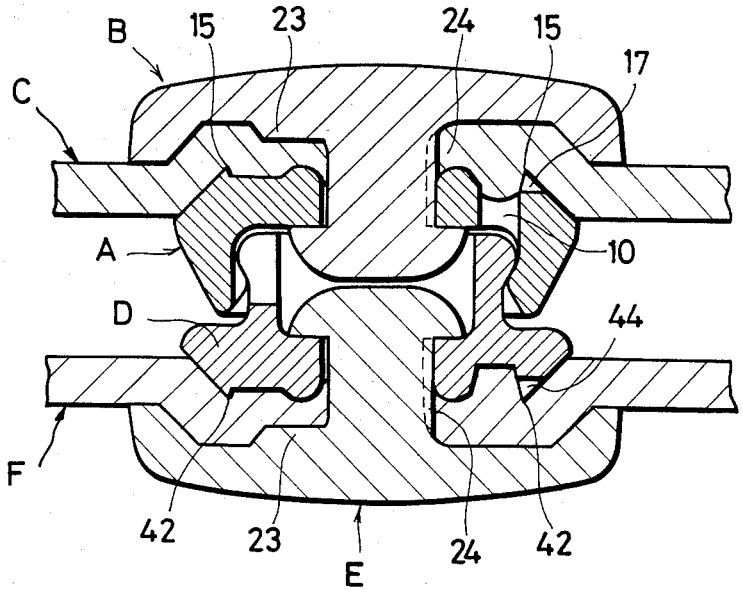
FIG. 15 is a cross-sectional view of the female and male members, showing the same having been coupled with one another and attached to the two fabric pieces separately.

FIGS. 6 and 7 illustrate a tack member B adapted to be joined with the female member A for attachment thereof to a fabric piece C (FIGS. 8 and 15). The tack member B has a head 20 and an integral shank 21 extending centrally from the head 20. The head 20 has an annular recess 22 disposed coaxially with the shank 21. On the bottom of the recess 22, there are disposed four ridges 23 of trapezoidal cross-section extending radially outwardly from the shank 21. The shank 21 is of circular cross-section and has a tapered end portion and four ribs 24 extending longitudinally of the shank 21 and terminating short of the tapered end portion.

In attachment of the female member A to the fabric piece C, the shank 21 of the tack member B is pierced through the fabric piece C, and then forcibly inserted through the aperture 8 of the female member A. Finally, the tapered end portion of the shank 21 is deformed, by axially compressing its tip end (at the cavity 7 of the socket 2), so as to prevent the female member A from being accidentally removed from the tack member B, as shown in FIG. 8.

As the female member A is thus attached to the fabric piece C, the fabric piece C is compressed by and sandwiched between the base 1 of the female member A and the head 20 of the tack member B, forcing the fabric piece C partially into the openings 10. As a result, the female member A is prevented from being angularly displaced relative to the fabric piece C. At the same time, since the ridges 23 of the head 20 bite into the fabric piece C, the tack member B is prevented from being angularly displaced relative to the fabric piece C and thus the female member A. Further, the female member A, when attached, looks thinner than it actually is, because the tapering edges 15 of the base 1 bite into the fabric piece C.

Figure 9:
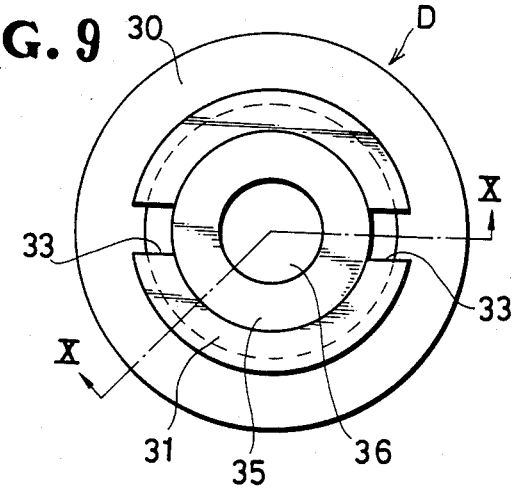
FIG. 9 is a plan view of a male member.
Figure 10:
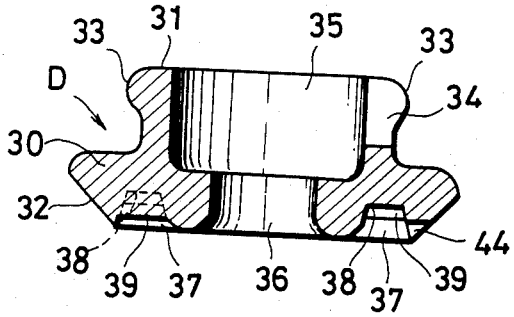
FIG. 10 is a cross-sectional view taken along line X—X of FIG. 9.
Figure 11:
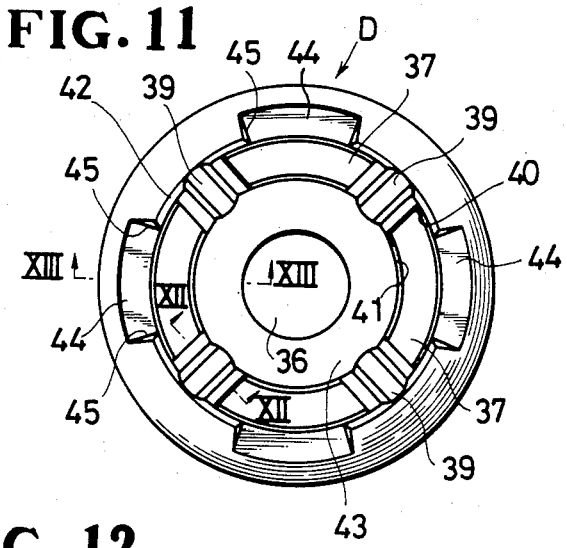
FIG. 11 is a bottom view of the male member of FIG. 9.

FIGS. 9-11 illustrate a male member D adapted to be coupled with the female member A. The male member D has a circular plate-like base 30 and a plug 31 integral therewith, the base 30 being engageable, on its lower or under surface, with another fabric piece F when the male member D is attached to the fabric piece F as described below in connection with FIG. 15. The base 30 has a peripheral surface 32 sloping inwardly downwardly toward its under surface.

The plug 31 of the male member D has two outwardly directed semi-circular locking projections 33 engageable with the inwardly directed locking projections 6 of the female member A when the male and female members B and A are coupled together. The two semi-circular locking projections 33 are spaced apart from one another by two radial recesses 34, extending traversely of the projections 33.

Figure 12:
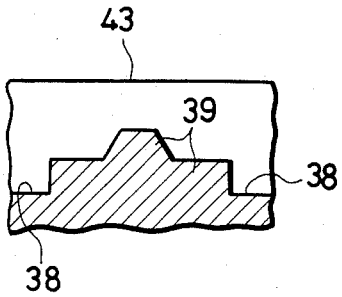
FIG. 12 is an enlarged fragmentary cross-sectional view taken along line XII—XII of FIG. 11.

The base 30 of the male member D has a central aperture 36 defined by an annular round-faced portion 43 (FIG. 13) and opening into a bore 35 in the plug 31. The base 30 also has, on its under face, an annular groove 37 concentric with the central aperture 36. Four double-stepped ridges 39 are disposed on the bottom 38 of the annular groove 37, the upper step of each ridge 39 being of trapezoidal cross-section, as shown in FIG. 12. Each double-stepped ridge 39 has a height smaller than that of the annular round-surfaced portion 43 defining the central aperture 36 and four tapering edges 42 of the base 30. A pair of concentric inner and outer side walls 41, 40, which defines the annular groove 37, are so inclined that the width of the groove 37 becomes smaller progressively toward its bottom 38.

Figure 13:
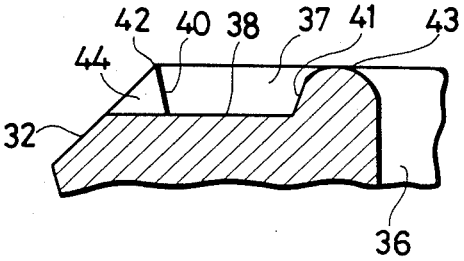
FIG. 13 is an enlarged fragmentary cross-sectional view taken along line XIII—XIII of FIG. 11.

The base 30, as shown in FIG. 13, has around the groove 37 four tapering edges 42 defined by the inclined peripheral surfaces 32 and the outer side wall 40. Each adjacent pair of the tapering edges 42 are spaced apart from one another by an arcuate recess 44 merging with the annular groove 37 and having a pair of circumferentially outwardly inclined end surfaces 45, 45 (FIG. 11).

Figure 14:
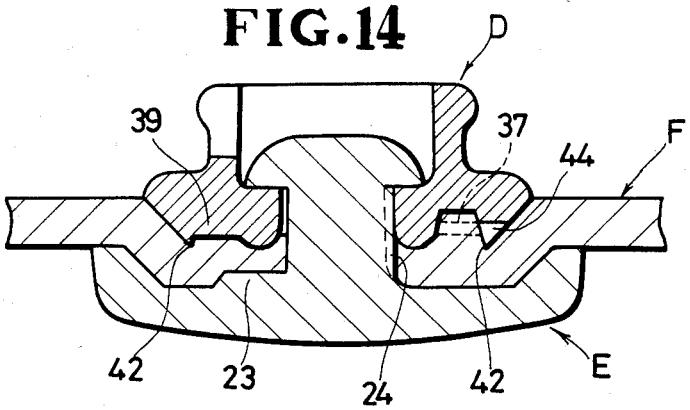
FIG. 14 is a cross-sectional view of the male member, showing the same having been attached to another fabric piece by another tack member.

As shown in FIG. 14, the male member D is attached to the fabric piece F by another tack member E of the same construction as the tack member B (FIGS. 6–8). For attachment of the male member D to the fabric piece F, the shank 21 of the tack member E is pierced through the fabric piece F and then forcibly inserted through the central aperture 36 of the male member D. Finally, the tapered end portion of the tack member E is deformed, by axially compressing its tip end, so as to prevent the tack member E from being accidentaly released from the male member D.

As the male member D is attached to the fabric piece F, the base 30 of the male member D and the head 20 of the tack member E compress the fabric piece F, forcing the same partly into both the annual groove 37 and the recesses 44. At that time, the tapered edges 42 bite into the fabric piece F. As a result, the male member D is prevented from being angularly displaced relative to the fabric piece F. Because the ridges 23 of the tack head 20 bite into the fabric piece F, the tack member E also is prevented from being angularly displaced relative to the fabric piece F and thus the male member D. The ribs 24 of the tack member's shank 21 serve to assist the ridges 23 in preventing angular displacement of the tack member E and the male member D relative to each other. Further, since the tapering edges 42 of the base 30 bite into the fabric piece F, the male member D looks thinner than it actually is.

To couple the female and male members A, D having been attached to the fabric pieces C, F separately by the respective tack members B, E as shown in FIGS. 8 and 14, the plug 31 of the male member D is forcibly inserted through the bore 5 of the socket 2 of the female member A, as shown in FIG. 15. The female and male members A, D thus coupled can be separated from each other by pulling the fabric pieces C, F in opposite facewise directions.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A snap-fit button assembly for attachment to a garment having two fabric pieces, comprising:

(a) a male and a female member molded and adapted to be coupled with one another;

(b) two tack members adapted to be joined with said male and female members, respectively, for attachment of the latter to the two fabric pieces separately, each of said tack members including a head and a central shank;

(c) said male member including a first base and a cylindrical plug integral therewith and defining a first axial bore, said first base having a first aperture opening into said first axial bore for reception of the central shank of one of said tack members, said plug having a plurality of outwardly directed locking projections around its free end portion;

(d) said female member including a second base and a cylindrical socket integral therewith and defining a second axial bore receptive of said plug of said male member, said second base having a second central aperture opening into said second bore, said socket having a plurality of inwardly directed locking projections around its free end portion engageable with said outwardly directed locking projections of said plug of said male member when said male and female members are coupled together; and (e) said second base further having a plurality of openings, each communicating with said second bore and aligned with a respective one of said inwardly directed locking projections in a direction parallel to the axis of said socket.

2. A snap-fit button assembly according to claim 1, each of said openings having a center of curvature comprising an arcuate opening concentric with said second central aperture.

3. A snap-fit button assembly according to claim 2, said second base having a plurality of radial grooves in its one surface remote from said socket, each of said radial grooves being disposed between an adjacent pair of said arcuate openings.

4. A snap-fit button asembly according to claim 2, said second base also having a plurality of arcuate recesses each merging with a respective one of said openings and concentric as a group with said second central aperture.

5. A snap-fit button assembly according to claim 1, said first base having, in its one surface remote from said plug, an annular groove concentric with said first central aperture and also a plurality of arcuate recesses merging with and concentric as a group with said annular groove.

* * * * *